US012582240B2

(12) United States Patent
Smith

(10) Patent No.: US 12,582,240 B2
(45) Date of Patent: Mar. 24, 2026

(54) MATTRESS PROTECTOR

(71) Applicant: Martasz Smith, Chicago, IL (US)

(72) Inventor: Martasz Smith, Chicago, IL (US)

( * ) Notice: Subject to any disclaimer, the term of this patent is extended or adjusted under 35 U.S.C. 154(b) by 214 days.

(21) Appl. No.: 18/496,398

(22) Filed: Oct. 27, 2023

(65) Prior Publication Data

US 2025/0134275 A1 May 1, 2025

(51) Int. Cl.
*A47C 31/10* (2006.01)
*A47C 21/02* (2006.01)

(52) U.S. Cl.
CPC ..... *A47C 31/105* (2013.01); *A47C 21/022* (2013.01)

(58) Field of Classification Search
CPC ..... A47C 31/105; A47C 31/113; A47C 21/02; A47C 21/022; A47C 27/002; A47C 27/005
See application file for complete search history.

(56) References Cited

U.S. PATENT DOCUMENTS 4,097,943 A 7/1978 O'Connell
4,445,242 A * 5/1984 Bowen ..... A61F 5/485 5/923
4,627,122 A * 12/1986 Hopp ..... A61F 5/485 5/487
5,701,617 A * 12/1997 Colby ..... A47C 31/105 5/923
6,233,762 B1 * 5/2001 Bradley ..... A47C 21/022 5/500
8,332,976 B1 * 12/2012 Goldwater ..... A47G 9/02 5/484
10,433,651 B2 10/2019 Smith et al.
11,324,328 B1 * 5/2022 Posner ..... A47C 27/122
12,303,035 B2 * 5/2025 Anderson ..... A47C 27/056
2008/0086814 A1 * 4/2008 Wootten ..... A47C 27/005 5/497
2008/0222805 A1 * 9/2008 Saunders ..... A47C 27/007 5/484
2009/0172881 A1 7/2009 Peterson
2011/0173756 A1 * 7/2011 Chung ..... A47C 27/005 5/655
2012/0073049 A1 * 3/2012 Walker ..... A47G 9/0246 5/500
2017/0368783 A1 * 12/2017 Pool ..... B32B 1/00
2018/0168362 A1 * 6/2018 Dorfman ..... A47C 31/123
2024/0206635 A1 * 6/2024 Rubin ..... A47G 9/02

FOREIGN PATENT DOCUMENTS

GB 2506433 A 4/2014

* cited by examiner

*Primary Examiner* — George Sun
(74) *Attorney, Agent, or Firm* — Crowell & Moring LLC

(57) ABSTRACT

A mattress protector is provided herein. In example embodiments, a mattress protector includes a waterproof sheet attached to at least one strap removably couplable to itself. The waterproof sheet includes at least one fabric section having a top surface configured to engage with an adhesive of an underpad.

20 Claims, 5 Drawing Sheets

MATTRESS PROTECTOR

BACKGROUND

The present disclosure generally relates to mattress protectors. More particularly, the present disclosure relates to mattress protectors that removably receive an underpad and secure the underpad to a mattress.

Seniors and people with certain medical conditions may suffer from incontinence or involuntary bowel movements during a night of sleep. Similarly, infants may wet the bed, or vomit, while placed in a crib, or on a mattress. As a result, mattresses and bedding are soiled. An underpad may be positioned over the mattress and bedding to protect the mattress and bedding from bodily fluid via absorption or prevention of leakage through the underpad. A dirty underpad then needs to be replaced with a new underpad after a night of use, resulting in the frequent application and removal of underpads to and from the mattress and bedding.

Generally, underpads use adhesives applied to locations on a bottom surface of the underpad to removably secure the underpads to a mattress or bedding. However, such underpads leave unwanted residue on the bedding that can be difficult to remove, even with the use of a washing machine. A person further produces body heat and moisture while sleeping, thereby increasing the likelihood that unwanted residue is left on the mattress or bedding because of the body heat and moisture's negative effect on the adhesive. Typically, a person's body heat and moisture cause the adhesive to melt (i.e., partially transition from a solid to a liquid), weaken (i.e., reduce strength), soften (i.e., reduce stiffness), and/or alter other chemical properties resulting in instability, such that the adhesive transfers from the underpad to the material on which the underpad is adhered. For example, when body heat and moisture causes the adhesive to melt, the adhesive may enter the pores and material of the mattress and bedding making it more difficult to remove. After melting into the pores and material of the mattress and bedding, the adhesive may further harden once the body heat around the adhesive decreases. In addition to the unwanted residue, underpads are generally prone to slipping, sliding, bunching, or shifting over the mattress and bedding. Such undesired movement of the underpad may be discomforting, disrupting to a night of sleep, and can even result in the underpad moving out of place, such that the mattress and bedding are no longer protected. The fabric and construction of the mattress and bedding affects the ability of an adhesive of an underpad to adhere to the mattress and bedding and, in turn, affects the frequency at which unwanted residue from or undesired movement of the underpad occurs.

Accordingly, the present disclosure addresses these problems by providing a mattress protector that removably receives and secures an underpad while preventing unwanted residue from an adhesive of the underpad on bedding, reducing undesired movement of the underpad, and providing an additional layer of protection to protect the mattress and bedding.

SUMMARY

The present embodiments provide a mattress protector. In one aspect, a mattress protector includes a waterproof sheet attached to at least one strap removably couplable to itself. The waterproof sheet includes at least one fabric section having a top surface configured to engage with an adhesive of an underpad.

In some embodiments, the at least one strap may include two straps attached to the waterproof sheet. A first strap of the two straps may be attached along a first edge of the waterproof sheet and a second strap of the two straps may be attached along a second edge of the waterproof sheet. The first edge of the waterproof sheet and the second edge of the waterproof sheet may be opposing edges of the waterproof sheet.

In some embodiments, the mattress protector may include four quadrants where each quadrant includes one or more fabric sections of the at least one fabric section. The mattress protector may also have a shape of a parallelogram having a corner in each of the four quadrants. Further, one or more of the fabric sections of the at least one fabric section may be positioned adjacent to each corner. Each of the at least one fabric sections may be 100 percent cotton. Additionally, the mattress protector may include the underpad with the adhesive applied to at least one location on a bottom surface of the underpad where the underpad is removably securable to the at least one fabric section via the adhesive.

In other embodiments, the waterproof sheet may include six portions arranged in an array of three equally spaced columns along a first direction and two equally spaced rows along a second direction where the first direction and the second direction are generally perpendicular and where each portion of the waterproof sheet includes one or more fabric sections of the at least one fabric section. The mattress protector may have two portions of the waterproof sheet located in a center column of the three equally spaced columns each including one or more fabric sections of the at least one fabric section. At least one of the one or more fabric sections in the center column may be larger than fabric sections outside the center column.

Further, the waterproof sheet may have a width generally parallel to the two straps where the width of the waterproof sheet is less than or equal to eighty-five inches and greater than or equal to fifty inches, and the at least one strap may be at least one adjustable strap. The waterproof sheet may also have a shape of a parallelogram having a perimeter where each portion of the waterproof sheet includes one or more fabric sections of the at least one fabric section positioned adjacent to the perimeter of the waterproof sheet. The at least one fabric section may be 100 percent cotton. Additionally, the mattress protector may include the underpad with the adhesive applied to at least one location on a bottom surface of the underpad where the underpad is removably securable to the at least one fabric section via the adhesive.

In another aspect, a mattress protector may include a waterproof sheet attached to a positioning assembly configured to be removably positionable around a mattress where the waterproof sheet includes at least one fabric section having a top surface configured to removably engage with at least one underpad having an adhesive applied to at least one location on a bottom surface of the at least one underpad via the adhesive. The positioning assembly may further have a width adjusting mechanism configured to adjust a width of the positioning assembly according to a size of the mattress. Further, the waterproof sheet may have a width generally parallel to the positioning assembly where the width of the waterproof sheet is less than or equal to eighty-five inches and greater than or equal to fifty inches and where the waterproof sheet is configured to wrap at least partially around a mattress having a width less than the width of the waterproof sheet.

In some embodiments, the waterproof sheet may include a centerline extending between a first edge and a second edge of the waterproof sheet where the at least one fabric section includes at least six fabric sections positioned adjacent to a perimeter of the waterproof sheet, and where two of the at least six fabric sections are positioned along the centerline of the waterproof sheet and are larger than the remaining fabric sections of the at least one fabric section. The mattress protector may also include the at least one underpad with the adhesive applied to the at least one location on the bottom surface of the at least one underpad where a first underpad of the at least one underpad is removably securable via the adhesive to two fabric sections of the at least six fabric sections adjacent to the perimeter of the waterproof sheet and to the two larger fabric sections positioned along the centerline of the waterproof sheet. Further, a second underpad of the at least one underpad may be removably securable via the adhesive to the same two larger fabric sections positioned along the centerline of the waterproof sheet as the first underpad and to two different fabric sections of the at least six fabric sections than the first underpad.

In yet another aspect, a method of using the mattress protector of certain embodiments may include placing the mattress protector on a mattress, wrapping the at least one strap around the mattress, coupling the at least one strap to itself, aligning the underpad with the adhesive applied to at least one location on a bottom surface of the underpad such that the adhesive aligns with the at least one fabric section of the waterproof sheet, and adhering the underpad to the waterproof sheet via the adhesive.

In a further aspect, a method of using the mattress protector of certain embodiments may include placing the mattress protector on a mattress, positioning the positioning assembly around the mattress, adjusting the width of the positioning assembly via the width adjusting mechanism to the size of the mattress, aligning the at least one underpad with the adhesive applied to the at least one location on the bottom surface of the underpad such that the adhesive aligns with the at least one fabric section of the waterproof sheet, and adhering the at least one underpad to the waterproof sheet via the adhesive.

Other apparatuses, systems, methods, features, and advantages of the described embodiments will be, or will become, apparent to one with skill in the art upon examination of the following figures and detailed description. It is intended that all such additional apparatuses, systems, methods, features and advantages be within the scope of the disclosure, and be encompassed by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the disclosure. Moreover, in the figures, like referenced numerals designate corresponding parts throughout the different views.

DETAILED DESCRIPTION

Figure 1:
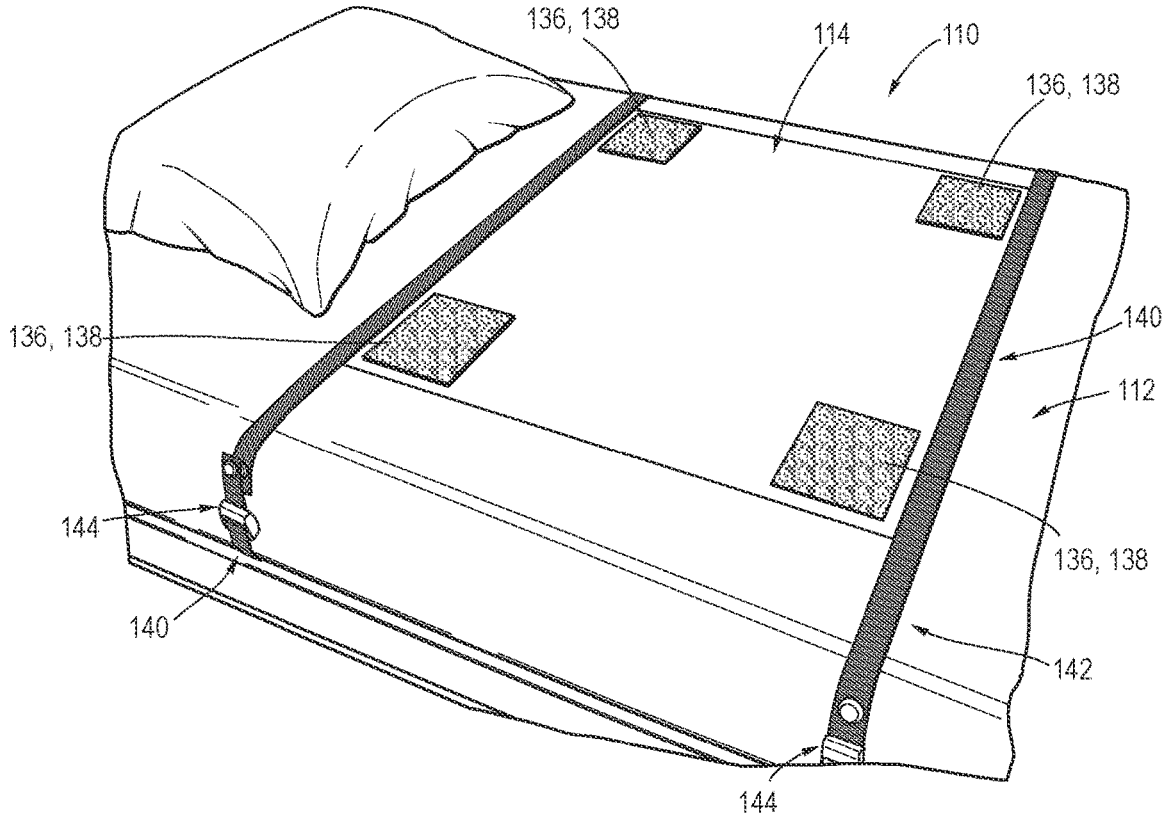
FIG. 1 is an isometric perspective of a mattress protector according to certain embodiments.

FIGS. 1-8 illustrate embodiments of a mattress protector. Generally, a mattress protector 110 is positioned on top of a mattress 112. The mattress protector 110 includes a waterproof sheet 114. The mattress protector further includes at least one strap 140 or a positioning assembly 242 that is attached to the waterproof sheet 114 and that removably secures or positions the waterproof sheet 114 to the mattress 112. The waterproof sheet 114 includes at least one fabric section 136 having a top surface 138. The top surface 138 is configured to engage with an adhesive 152 of an underpad 146 to removably receive and secure the underpad 146 to the mattress protector 110.

Figure 2:
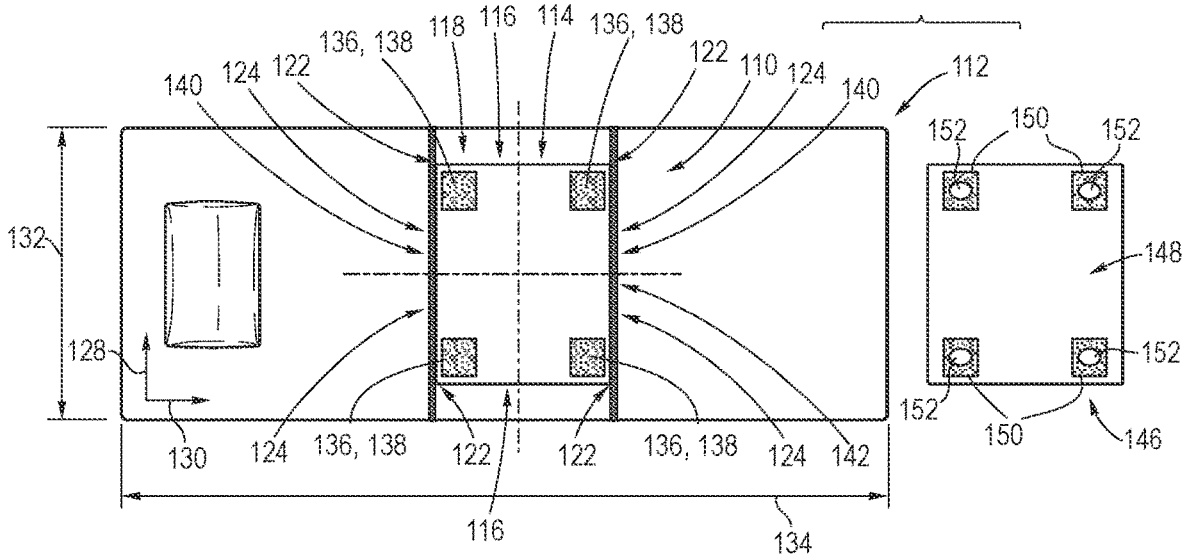
FIG. 2 is a top perspective of the mattress protector of FIG. 1 and a bottom perspective of an underpad.

The mattress 112 may be positioned on a box spring, a frame, a box, a floor or a combination thereof. The box spring may comprise any suitable box spring, for example a wooden box spring or any other commonly available box spring. The frame may include any suitable frame, for example a metallic or wooden frame, which may include legs positioned on a floor, or an infant crib. The mattress 112 may include any suitable mattress, such as a spring mattress, foam mattress, memory foam mattress, gel mattress, water mattress, air mattress, or any other commonly available mattress. The mattress 112 may have any suitable size, such as crib (28"×52"), small single (30"×75"), twin (38"×75"), twin XL (38"×80"), full (54"×74"), full XL (54"×80"), queen (60"×80"), Olympic queen (66"×80"), king (76"×80"), California king (72"×84"), or any other commonly available size or shape. The listed dimensions are approximations of suitable and commonly available mattress sizes and are not limited to these exact dimensions. Generally, the first number listed in parenthesis corresponds to a width 132 of the mattress 112 and the second number corresponds to a length 134 of the mattress 112, as shown in FIG. 2. But "width" and "length" may be used interchangeably. The mattress 112 may also have a bed sheet, such as a fitted sheet, a loose sheet, both, or multiple sheets that are positioned on the mattress 112.

The underpad 146 may include any suitable underpad commonly known in the arts. Generally, the underpad 146 may include a waterproof layer, such as a plastic sheet or other commonly available substantially impermeable material. The underpad 146 may also include an absorbent material, such as gels, foams, cottons, or other commonly available absorbent materials. The underpad 146 has a bottom surface 148. Generally, the underpad 146 is positioned on the mattress 112, usually on the mattress's bedding, via an adhesive 152 applied to at least one location 150 on the bottom surface 148 of the underpad 146 as shown in FIG. 2. The at least one location 150 may include four locations adjacent to corners of the underpad 146 but is not limited to this arrangement. In one non-limiting example of an underpad 146, the underpad may have an approximate size of 30"×60" with an adhesive 152 applied to a bottom surface 148 at 1"×1" locations 150.

As mentioned above, applying the underpad 146 via the adhesive 152 directly to the mattress 112 and its bedding may leave unwanted, difficult to remove residue on the mattress 112 and its bedding. Further, certain fabrics or constructions of fabric may result in greater amounts of unwanted residue from the adhesive 152. The adhesive 152 also may not sufficiently adhere to certain fabrics or constructions of fabric resulting in undesirable movement of the underpad 146 while an individual is sleeping. In non-limiting examples, applying the underpad 146 via the adhesive 152 to cotton, especially 100% cotton, may result in less unwanted residue from the adhesive 152 on the mattress 112 and its bedding and/or less undesirable movement of the underpad 146. The use of other fabrics, such as microfiber, jersey sheets, silk, polyester, and/or combinations thereof, may not result in less unwanted residue and/or undesirable movement of the underpad 146 and/or may not be as effective as cotton, especially 100% cotton. Discussed in greater detail below, embodiments of the mattress protector 110 solve these problems when the mattress protector 110 is positioned on top of the mattress 112 to removably receive and secure the underpad 146.

Also, as mentioned above, the mattress protector includes at least one strap 140 or a positioning assembly 242. Examples of straps 140, alternatively referred to as belts or similar terms, and positioning assemblies 242 in the art are disclosed in U.S. Pat. No. 10,433,651, which is hereby incorporated by reference in its entirety. Referring to FIGS. 1-4, in preferred embodiments, the mattress protector includes the waterproof sheet 114 having edges 116 that form a perimeter 118 of the waterproof sheet 114. As shown in the figures, the waterproof sheet 114 may have the shape of a parallelogram, such as a square or rectangle, but the waterproof sheet 114 is not limited to any one shape or number of edges. For example, the waterproof sheet 114 may have a rounded shape or five or six edges. The at least one strap 140 attaches to the waterproof sheet 114 along the edge 116. In embodiments including two straps 140, the first strap 140 attaches along the first edge 116 and the other of the two straps 140 attaches along the second edge 116. The first edge 116 and the second edge 116 are opposing edges of the waterproof sheet 114 and may be generally parallel to one another.

The at least one strap 140 is not limited to attaching to the waterproof sheet 114 along edges 116. For example, in some embodiments, the at least one strap 140 may have a first end that attaches at a first location to the waterproof sheet 114 and a second end that attaches at a second location to the waterproof sheet 114. The first end of the at least one strap 140 may attach at or near the edge 116 and the second end may attach at or near the edge 116, such that the ends of the at least one strap 140 attach at or near opposing edges 116 of the waterproof sheet 114. Ends of the at least one strap 140 may also attach at or near adjacent edges 116 of the waterproof sheet 114. In embodiments with two straps 140, the first end and the second end of each of the two straps 140 may attach at or near a first edge 116 via their first ends and attach at a second edge 116 via their second ends, such that the two straps are spaced apart from one another and are generally parallel to one another. The two straps 140 may also be arranged such that they are generally perpendicular to one another.

In some embodiments, the at least one strap 140 may be positioned orthogonal to a longitudinal axis of the mattress 112 and wrapped around the mattress 112. In other embodiments, the at least one strap 140 may be positioned parallel to the longitudinal axis of the mattress 112 and wrapped around the mattress 112. Also, where there are at least two straps 140, the at least two straps 140 may include at least one strap 140 that is positioned orthogonal to the longitudinal axis of the mattress 112 and may include at least one strap 140 that is positioned parallel to the longitudinal axis of the mattress.

The at least one strap 140 may be formed from any suitable material or combination of materials. For example, leather, polymer, nylon, cotton, silk, elastic, plastic, hook-and-hoop fasteners, etc. may be used. The at least one strap 140 may be formed from an inflexible or non-elastic material, or a flexible or elastic material. The at least one strap 140 may be attached to the waterproof sheet 114 via adhesive (e.g., glue), mechanical connection (e.g., staples, pins, sewing thread, buttons), or any other suitable coupling mechanism for attaching straps 140.

Additionally, in preferred embodiments, the at least one strap 140 is removably couplable to itself. A person may wrap the at least one strap 140 around a mattress 112 and couple the at least one strap 140 to itself, thereby removably securing the waterproof sheet 114 atop the mattress 112. The at least one strap may be removably couplable via buttons, zips, clips, hooks, VELCRO®, or any other mechanism for coupling the at least one strap 140 to itself.

In some embodiments, the at least one strap 140 may be at least one adjustable strap 140. The at least one adjustable strap 140 has an adjustable length to correspond to a size of the mattress 112. In this manner, the at least one adjustable strap 140 may be compatible with any size mattress. The at least one adjustable strap 140 may include a ring, slider, a strap adjuster, a winch, or other similar length adjusting mechanisms. While two straps 140 are generally discussed and shown in FIGS. 1-4, it is to be understood that the embodiments disclosed herein are not limited to two straps 140 (i.e., it is possible to use one, three, four, or more straps).

Referring now to FIGS. 5-8, in some embodiments the mattress protector 210 includes a positioning assembly 242. The positioning assembly 242 is attached to a waterproof sheet 214 and is removably positionable around a mattress 212. The positioning assembly 242 may include at least one strap 240 as described above. The positioning assemblies 242 may also include the structures disclosed in U.S. Pat. No. 10,433,651, which is incorporated by reference in its entirety (as noted above) and to expressly incorporate the structures of positioning assemblies disclosed therein. In some embodiments, the positioning assembly 242 may include a width adjusting mechanism 244 that adjusts a width of the positioning assembly 242 according to a size of a mattress 212. The width adjusting mechanism 244 may be at least one adjustable strap 240 as described above and may include a ring, slider, a strap adjuster, a winch, or other similar width adjusting mechanisms. The width adjusting mechanism 244 may also include the structures disclosed in U.S. Pat. No. 10,433,651, which is incorporated by reference in its entirety (as noted above) and to expressly incorporate the structures of length adjusting mechanisms disclosed therein. In this manner, the positioning assembly 242 may be compatible with any size mattress.

Referring again to FIGS. 1-4, preferred embodiments of the mattress 112 includes the waterproof sheet 114. The waterproof sheet 114 generally consists of waterproof or impermeable material to protect a mattress 112 from bodily fluids or discharge that are not absorbed by or otherwise prevented from leaking through an underpad 146. The waterproof sheet 114 may include a single layer or multi-layer plastic, impermeable sheet, absorbent material, or formed from any other suitable waterproof material. Beneficially, the waterproof sheet 114 may be washed or cleaned by hand or in a laundry machine. By washing or cleaning the waterproof sheet 114, unwanted residue leftover from an adhesive 152 from an underpad 146 may be removed and the waterproof sheet 114 may be reused.

The waterproof sheet 114 has a length and a width. In some embodiments, the length of the waterproof sheet 114 is in a direction generally parallel to a longitudinal axis of a mattress 112 and the width of the waterproof sheet 114 is generally perpendicular to the longitudinal axis. The width of a waterproof sheet 114 may be generally parallel to at least one strap 140 that is attached to the waterproof sheet 114. The width of the waterproof sheet may also be less than or equal to eight-five inches and greater than or equal to fifty inches. In other embodiments, the length and the width of the waterproof sheet 114 may be switched (i.e., the length of the waterproof sheet may be generally perpendicular to the longitudinal axis of the mattress 112).

Further, the length and the width of the waterproof sheet 114 may correspond to any size mattress 112. For example, the waterproof sheet 114 may be sized to a twin, queen, or king mattress. The length of the waterproof sheet 114 may be less than a length 134 of the mattress 112 and may correspond to a length of a mid-section of a person (i.e., so the waterproof sheet 114 lays beneath a person's mid-section). The length of the waterproof sheet may also span an entire length 134 of the mattress 112. The width of the waterproof sheet 114 may span an entire width 132 of a mattress 112 such that the width of the waterproof sheet 114 is equal to the width 132 of the mattress 112. The width of the waterproof sheet 114 may also be less than the width 132 of the mattress 112 such that a gap or space exists between edges 116 of the waterproof sheet 114 and edges of the mattress 112. In other embodiments, the width of the waterproof sheet 114 may be greater than the width 132 of the mattress 112 such that the waterproof sheet may wrap at least partially around the mattress, which is discussed in greater detail below.

Figure 3:
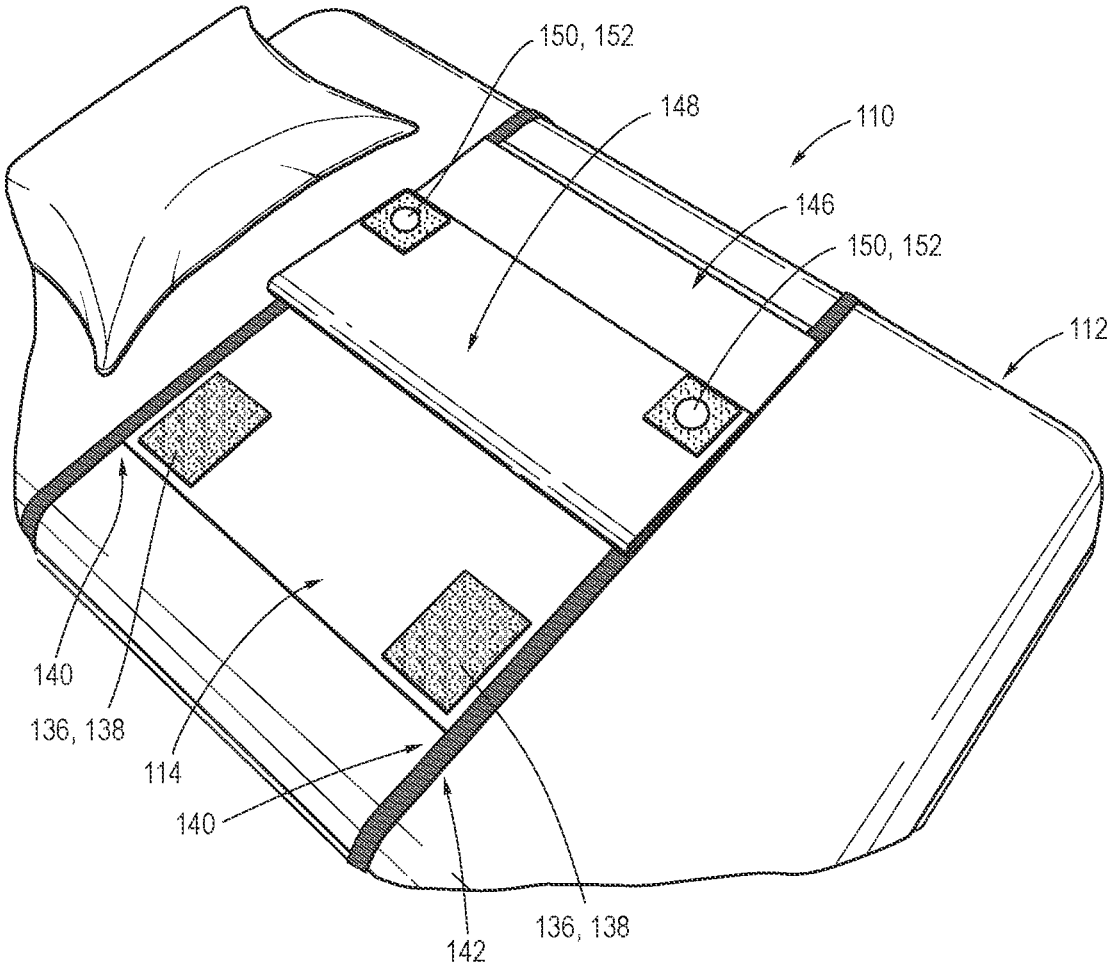
FIG. 3 is an isometric perspective of the mattress protector of FIGS. 1-2 with the underpad.
Figure 4:
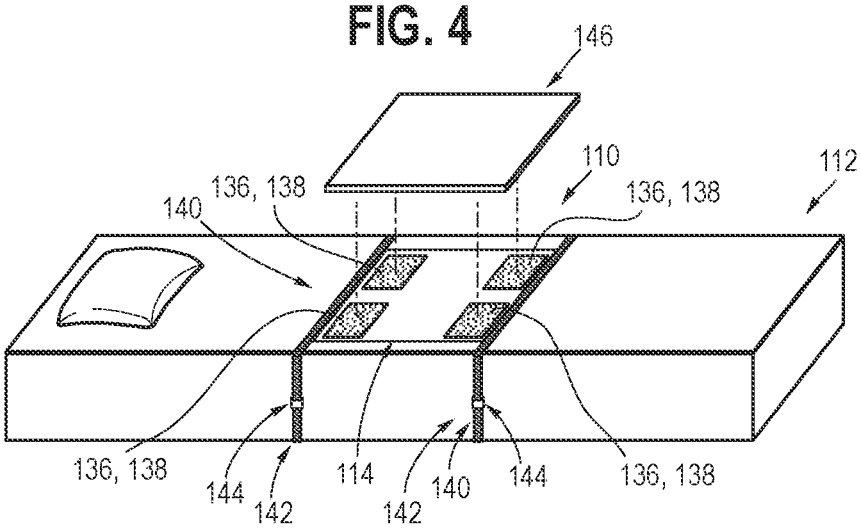
FIG. 4 is an isometric perspective of the mattress protector FIGS. 1-3 with the underpad.
Figure 5:
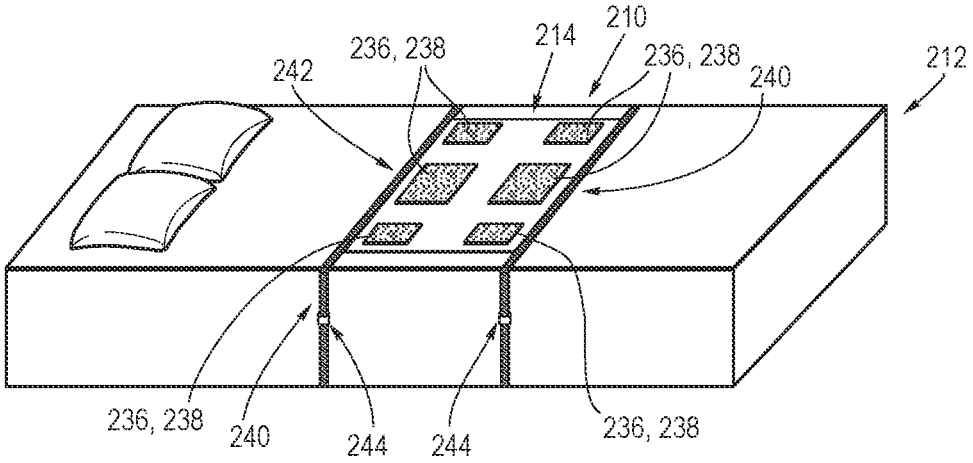
FIG. 5 is an isometric perspective of a mattress protector according to certain embodiments.

In preferred embodiments, a waterproof sheet 114 includes at least one fabric section 136 having a top surface 138. As shown in FIGS. 2-4, a location of the at least one fabric section 136 may correlate to locations 150 of an adhesive 152 on a bottom surface 148 of an underpad 146. In other words, when the underpad 146 is placed on a mattress protector 110, the at least one fabric section 136 aligns with locations 150 of the adhesive 152 of the underpad 146. The at least one fabric section 136 may consist of any fabric, in any shape, and any size that fits on the waterproof sheet 114. The shape and size of the at least one fabric section 136 may also correlate to the adhesive 150 of the underpad 146, such that the at least one fabric section 136 provides adequate surface area for the adhesive 150. For example, the fabric section may consist of cotton, be in a square or rectangular shape, and is approximately 8"×9".

The at least one fabric section 136 should consist of a fabric that adheres well to the adhesive 152 of the underpad 146. For example, the at least one fabric section may consist of at least 50% cotton, or similar fabric. In another example, the at least one fabric section may consist of at least 75% cotton, or similar fabric. In yet another example, the at least one fabric section may consist of 100% cotton, or similar fabric. In this manner, the at least one fabric section 136 may provide a better surface for the adhesive 152 of the underpad 146 to adhere to than the waterproof sheet 114 itself. Not only may the adhesion between the at least one fabric section 136 and the underpad 146 be stronger, but unwanted residue on the mattress protector 110 subsequent to removal of the underpad 146 to the mattress protector 110 may also be reduced, especially when a person's body heat and moisture negatively affects adhesion between the underpad 146 and the mattress protector 110 while the person is sleeping. As noted above, a person's body heat and moisture may cause the adhesive to melt, weaken, soften, and/or alter other chemical properties resulting in instability, such that the adhesive transfers from the underpad to the material on which the underpad is adhered (including into the material's pores). Certain materials, such as cotton or similar fabrics, may absorb or control heat and moisture better than other materials, such as microfiber, silk, and/or polyester, resulting in a better local environment for stronger adhesion and less transfer of the adhesive 152 (which results in unwanted residue). Certain materials, such as cotton or similar fabrics, may also provide a better surface via their construction (i.e., weaving or fabric pattern) and/or chemical composition (including possible coating on the fabric) than other constructions and/or compositions, such as jersey sheets, that results in stronger adhesion and less transfer of the adhesive 152 (which results in unwanted residue). Thus, as seen in FIG. 4, the at least one fabric section 136 is configured to engage with the adhesive 152 of the underpad 146. The at least one fabric section 136 is also configured to removably engage with at least one underpad 146 having the adhesive 152 applied to at least one location 150 on a bottom surface 148 of the at least one underpad 146 via the adhesive 152. While the use of certain fabrics and/or constructions may result in more unwanted reside from the adhesive 152 and more undesired movement of the underpad 146, those fabrics (i.e., microfiber, jersey sheets, silk, polyester, etc.) may still be used for the fabric section 136. Further, while the section 136 is referred to as a fabric section, it is also possible to use other materials, such as plastic or flexible thin metal (like aluminum foil), but other materials may not be as comfortable during sleep.

Referring to FIG. 2, in some embodiments, a waterproof sheet 114 may include four quadrants 124, where each quadrant 124 includes one or more fabric sections 136, or includes at least a part of one or more fabric sections 136. Generally, the quadrants 124 are the same size as one another, but the quadrants 124 may also have varying sizes. The waterproof sheet 114 may have the shape of a parallelogram having a corner 122 in each of the four quadrants 124. One or more fabric sections 136 may be positioned adjacent to each corner 122. In embodiments where the waterproof sheet 114 is not in the shape of a parallelogram, the one or more fabric sections 136 may still be located adjacent to each corner 122. In other embodiments without corners 122, the one or more fabric sections 136 may be adjacent to an edge 116 in each quadrant 124.

Figure 6:
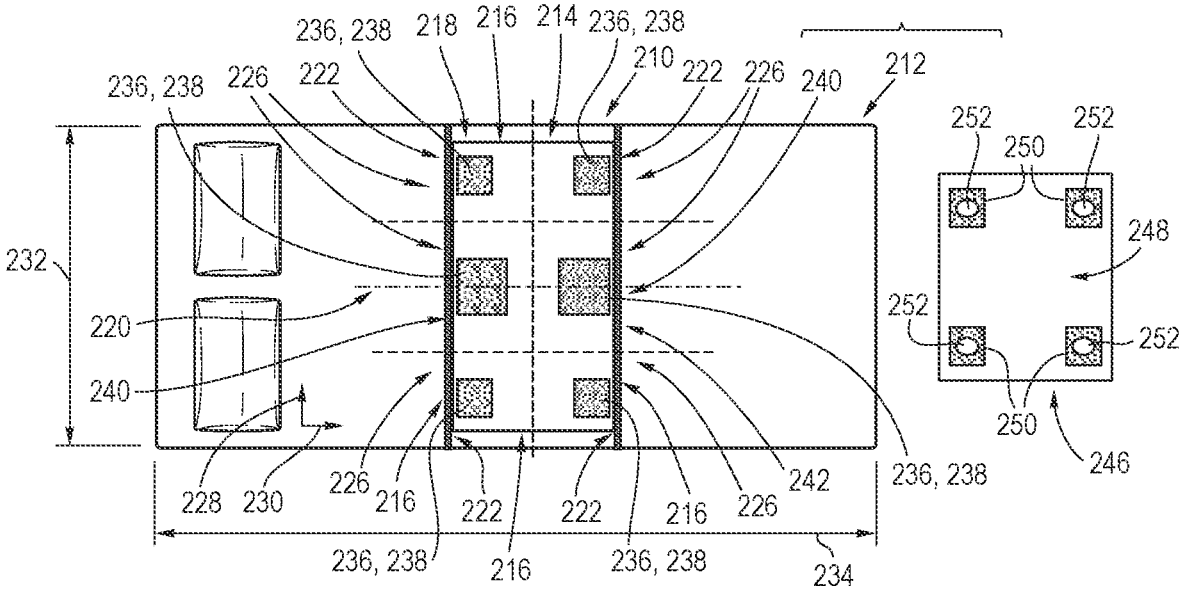
FIG. 6 is a top perspective of the mattress protector of FIG. 5 with a bottom perspective of at least one underpad.

Referring now to FIG. 6, in some embodiments, a waterproof sheet 214 may include six portions 226 arranged in an array of three equally spaced columns along a first direction 228 and two equally spaced rows along a second direction 230. The first direction 228 and the second direction 230 may be generally perpendicular. The first direction 228 may be generally parallel to a width 232 of a mattress 212 while the second direction 230 may be generally parallel to a length 234 of the mattress 212. Each portion 226 may include one or more fabric sections 236, or at least a part of one or more fabric sections 236. In other embodiments, the portions 226 may not be equally spaced on the waterproof sheet 214. The first direction 228 may also be generally parallel to the length 234 while the second direction 230 may be generally parallel to the width 232.

Figure 8:
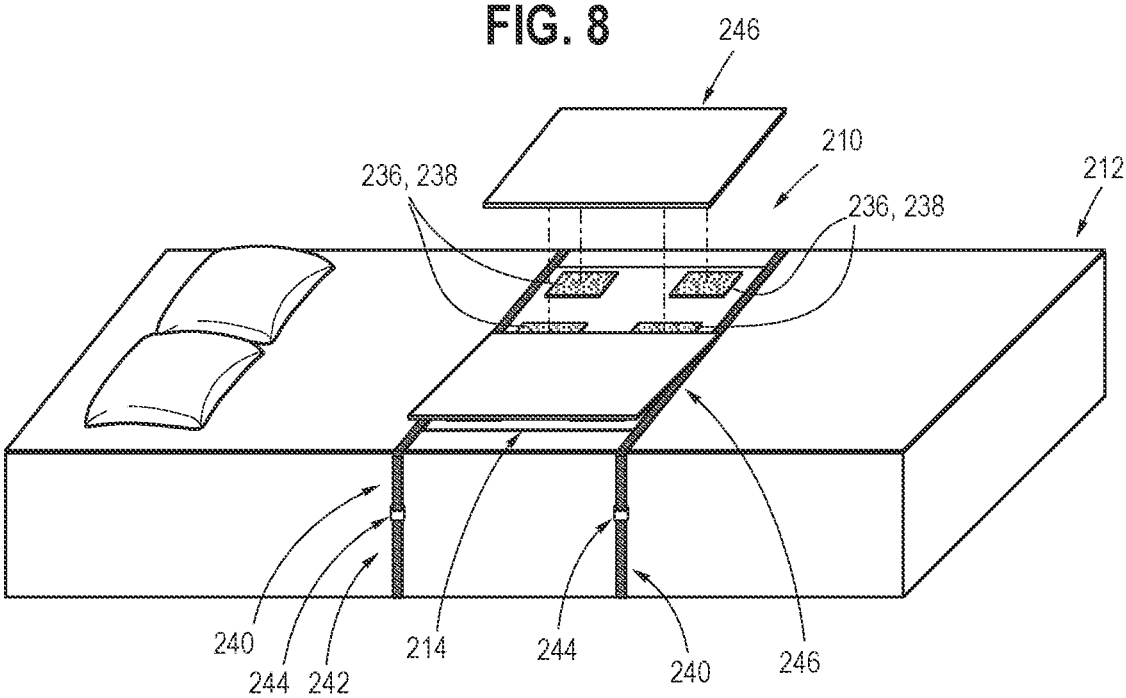
FIG. 8 is an isometric perspective of the mattress protector of FIGS. 5-7 with the at least one underpad.

In example embodiments, a waterproof sheet 214 may include a centerline 220 extending between a first edge 216 and a second edge 216 of the waterproof sheet 214. The centerline 220 may be generally parallel to a length 234 of a mattress 212. At least one fabric section 236 may be at least six fabric sections 236 positioned adjacent to a perimeter 218 of the waterproof sheet 214. Some of the fabric sections 236 may be larger than other fabric sections 236 (i.e., not all fabric sections 236 are necessarily the same size, shape, or material). In one non-limiting example, the fabric sections 236 may have an approximate size of 8"×9" (as noted above) while larger fabric sections 236 may have an approximate size of 8"×18". As shown in FIG. 6, at least two fabric sections 236 are positioned along the centerline 220 and may be larger fabric sections 236. In other embodiments, the larger fabric sections 236 may be positioned not on the centerline 220. Furthermore, as shown in FIGS. 6 and 8, a location of the at least one fabric section 236 may correlate to locations 250 of an adhesive 252 on a bottom surface 248 of an underpad 246. In other words, when the underpad 246 is placed on a mattress protector 210, the at least one fabric section 236 aligns with locations 250 of the adhesive 252 of the underpad 246. As noted above, the shape and size of the at least one fabric section 236 may also correlate to the adhesive 250 of the underpad 246, such that the at least one fabric section 236 provides adequate surface area for the adhesive 250. For larger fabric sections 236, the fabric sections 236 may be shaped and sized to correlate to two or more underpads 246.

Alternate embodiments are not limited to arrangements of the at least one fabric section 136 discussed in the example embodiments above. Accordingly, at least one fabric section 136 may be provided at any location on a waterproof 114. And in embodiments with at least two fabric sections 136 (or a plurality of fabric sections 136), the at least two fabric sections 136 may be in any arrangement. For example, the at least one fabric section 136 may be located in or near a center of the waterproof sheet 114. One skilled in the art will appreciate that there are various locations and arrangements to provide the at least one fabric 136 on the waterproof sheet 114.

Figure 7:
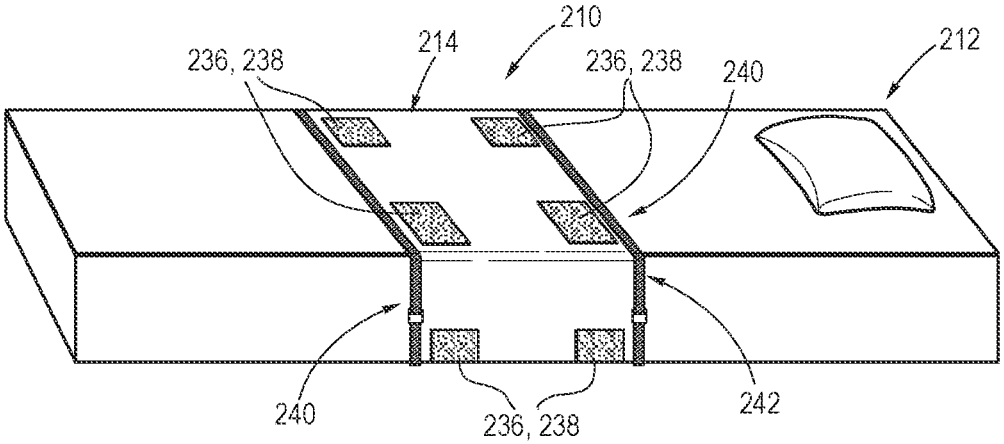
FIG. 7 is an isometric perspective of the mattress protector of FIGS. 5-6.

As shown in FIG. 7, in embodiments where a width of a waterproof sheet 214 is greater than a width 232 of a mattress 212, the waterproof sheet 214 is configured to wrap at least partially around the mattress 212. The waterproof sheet 214 may have at least six fabric sections 236. In this manner, when the waterproof sheet 214 is partially wrapped around the mattress 212, at least four fabric sections 236 may be located on top of the mattress 212 and configured to receive an adhesive 252 of an underpad 246. Other fabric sections 236 may then be located on a side or a bottom of the mattress 212 when the waterproof sheet 214 is wrapped at least partially around the mattress 212. When the same waterproof sheet 214 is used on a larger size mattress, the width of the waterproof sheet 214 may be less than or equal to a width 232 of a mattress 212. In this manner, the at least six fabric sections 236 may located on top of the mattress 212. Accordingly, the waterproof sheet 214 may be used on any size mattress while being configured to engage with an adhesive 252 of an underpad 246 and removably engage with at least one underpad 246 having the adhesive 252 applied to at least one location 250 on a bottom surface 248 of at least one underpad 246 via the adhesive 252.

Referring to FIG. 8, in example embodiments of a mattress protector 210 including a waterproof sheet 214 with at least one fabric section 236, there may be at least six fabric sections 236. Two fabric sections 236 of the at least six fabric sections may be larger than the remaining fabric sections 236. A first underpad 246 of at least one underpad 246, with an adhesive 252 applied to at least one location 250 on a bottom surface 248, may removably secure via the adhesive 252 to the two larger fabric sections 236 and two other fabric sections 236 positioned adjacent to a perimeter 218 of the waterproof sheet 214. A second underpad 246 of the at least one underpad 246 may also be removably securable via the adhesive 252 to the same two larger fabric sections 236 and to two different fabric sections 236 of the at least six fabric sections 236 than the first underpad 246. Thus, the mattress protector 210 may be configured to removably secure at least two underpads 246 where larger fabric sections 236 can engage the adhesives 252 of at least two separate underpads 246. Depending on the individual needs of a person or persons sleeping on a mattress 212 and its bedding, the mattress protector 210 may be designed to removably receive and secure one, two, or more underpads 246.

Figure 9:
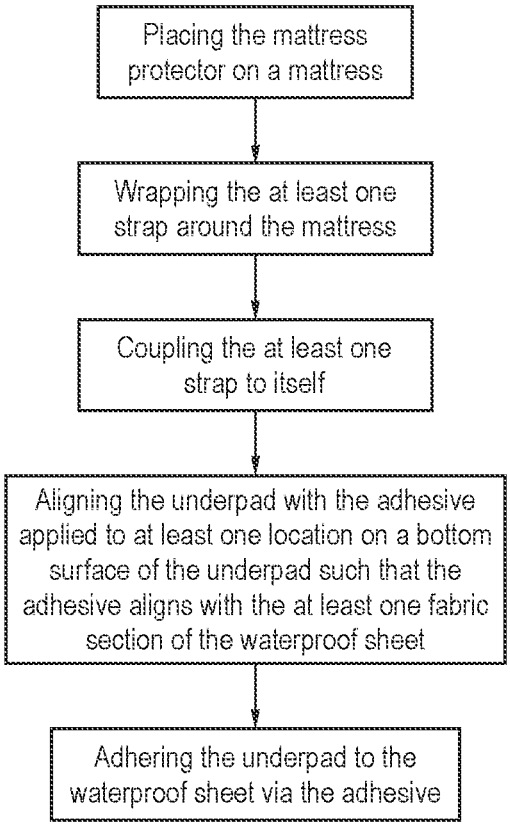
FIG. 9 is a flow chart for a method of using a mattress protector according to certain embodiments.

Methods of using a mattress protector 110 are also disclosed herein. Referring to FIG. 9, example embodiments of using a mattress protector 110 may include placing the mattress protector 110 on a mattress 112, optionally, wrapping at least one strap 140 around the mattress 112, and, optionally, coupling the at least one strap 140 to itself. The method also includes aligning an underpad 146 with an adhesive 152 applied to at least one location 150 on a bottom surface 148 of the underpad 146 such that the adhesive 152 aligns with the at least one fabric section 136 of a waterproof sheet 114 of the underpad 146. The method further includes adhering the underpad 146 to the waterproof sheet 114 via the adhesive 152. The method may also include wrapping the waterproof sheet 114 at least partially around the mattress 112 and adhering two underpads 146 to the waterproof sheet 114. Additionally, the method may include removing the underpad or underpads 146 from the waterproof sheet 114, optionally, decoupling the at least one strap 140 from itself and removing the mattress protector 110 from the mattress 112, and, optionally, cleaning the waterproof sheet 114 and the mattress protector 110.

Figure 10:
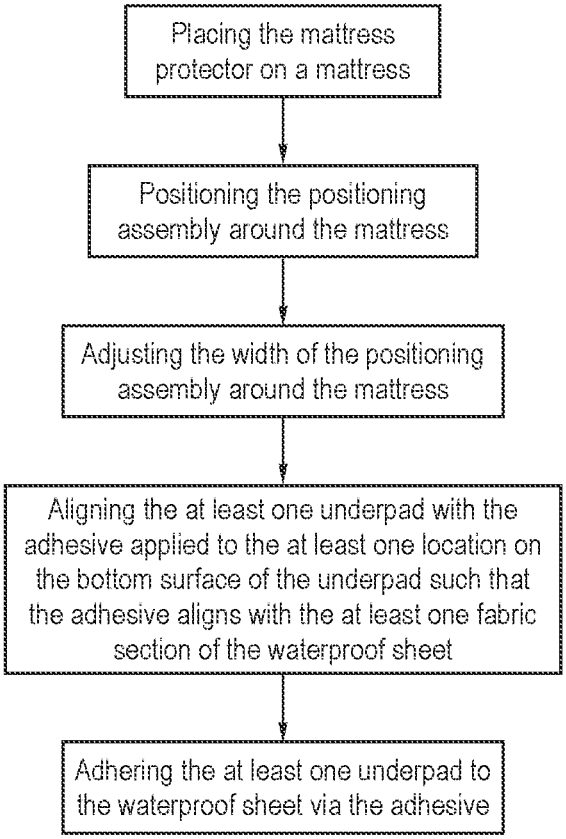
FIG. 10 is a flowchart for a method of using a mattress protector according to certain embodiments.

Referring to FIG. 10, example embodiments of using a mattress protector 210 may include placing the mattress protector 210 on a mattress 212, optionally, positioning a positioning assembly 242 around the mattress 212, and, optionally, adjusting a width 232 of the positioning assembly 242 via a width adjusting mechanism 244 to a size of the mattress 212. The method also includes aligning at least one underpad 246 with an adhesive 252 applied to at least one location 250 on a bottom surface 248 of the underpad 246 such that the adhesive 252 aligns with at least one fabric section 236 of a waterproof sheet 214. The method further includes adhering the at least one underpad 246 to the waterproof sheet 214 via the adhesive 252. The method may also include wrapping the waterproof sheet 214 at least partially around the mattress 212 and adhering two underpads 246 to the waterproof sheet 214. Additionally, the method may include removing the underpad or underpads 246 from the waterproof sheet 214, optionally, removing the positioning assembly 242 and the mattress protector 210 from the mattress 212, and, optionally, cleaning the waterproof sheet 214 and the mattress protector 210.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

One skilled in the art will realize that a virtually unlimited number of variations to the above descriptions are possible, and that the examples and the accompanying figures are merely to illustrate one or more examples of implementations. In the above description, certain terms may be used such as "up," "down." "upper." "lower," "top," "bottom." "left." "right," and the like. Where applicable, these terms are used to provide some clarity of description when dealing with relative relationships. But these terms are not intended to imply absolute relationships, positions, or orientations. For example, for an object, an "upper" surface can become a "lower" surface simply by turning the object over. Nevertheless, it is still the same object. Further, the terms "including," "comprising," "having," and variations thereof mean "including but not limited" unless expressly specified.

It will be understood by those skilled in the art that various other modifications can be made, and equivalents can be substituted, without departing from claimed subject matter. Additionally, many modifications can be made to adapt a particular situation to the teachings of claimed subject matter without departing from the central concept described herein. Therefore, it is intended that claimed subject matter not be limited to the particular embodiments disclosed, but that such claimed subject matter can also include all embodiments falling within the scope of the appended claims, and equivalents thereof.

In the detailed description above, numerous specific details are set forth to provide a thorough understanding of claimed subject matter. However, it will be understood by those skilled in the art that claimed subject matter can be practiced without these specific details. In other instances, methods, devices, or systems that would be known by one of ordinary skill have not been described in detail so as not to obscure claimed subject matter.

Reference throughout this specification to "one embodiment" or "an embodiment" can mean that a particular feature, structure, or characteristic described in connection with a particular embodiment can be included in at least one embodiment of claimed subject matter. Thus, appearances of the phrase "in one embodiment" or "an embodiment" in various places throughout this specification are not necessarily intended to refer to the same embodiment or to any one particular embodiment described. Furthermore, it is to be understood that particular features, structures, or characteristics described can be combined in various ways in one or more embodiments. In general, of course, these and other issues can vary with the particular context of usage. Therefore, the particular context of the description or the usage of these terms can provide helpful guidance regarding inferences to be drawn for that context.

What is claimed is:

1. A mattress protector, comprising:

a waterproof sheet attached to at least one strap removably couplable to itself, wherein the waterproof sheet includes at least four separate fabric sections, with at least one fabric section in each quadrant of the waterproof sheet, each fabric section having a top surface to directly engage with an adhesive of an underpad.

2. The mattress protector of claim 1, wherein the waterproof sheet has a shape of a parallelogram having a corner in each of the four quadrants, and wherein the at least one fabric section in each quadrant is positioned adjacent to each corner.

3. The mattress protector of claim 2, wherein each of the at least one fabric sections is 100 percent cotton.

4. The mattress protector of claim 2, the mattress protector further comprising the underpad with the adhesive applied to at least one location on a bottom surface of the underpad, wherein the underpad is removably securable to the at least one fabric section via the adhesive.

5. The mattress protector of claim 1, the waterproof sheet comprising six separate fabric sections arranged in an array of three equally spaced columns along a first direction and two equally spaced rows along a second direction, wherein the first direction and the second direction are generally perpendicular, and wherein each of the six separate fabric sections of the waterproof sheet has the top surface to directly engage with the adhesive of the underpad.

6. The mattress protector of claim 5, wherein two of the six separate fabric sections of the waterproof sheet are located in a center column of the three equally spaced columns, and wherein the two of the six separate fabric sections in the center column are larger than the remaining fabric sections outside the center column.

7. The mattress protector of claim 6, wherein the at least one strap includes two straps attached to the waterproof sheet, the waterproof sheet has a width generally parallel to the two straps, and wherein the width of the waterproof sheet is less than or equal to eighty-five inches and greater than or equal to fifty inches, and wherein the at least one strap is at least one adjustable strap.

8. The mattress protector of claim 6, wherein the waterproof sheet has a shape of a parallelogram having a perimeter, and wherein each of the six separate fabric sections of the waterproof sheet includes at least one fabric section positioned adjacent to the perimeter of the waterproof sheet.

9. A method of using the mattress protector of claim 1, comprising:

placing the mattress protector on a mattress;

wrapping the at least one strap around the mattress;

coupling the at least one strap to itself;

aligning the underpad with the adhesive applied to at least one location on a bottom surface of the underpad such that the adhesive aligns with the at least one fabric section in each quadrant of the waterproof sheet; and adhering the underpad to the waterproof sheet via the adhesive.

10. The mattress protector of claim 1, wherein the top surface of each fabric section is uncovered and opened from above to directly engage with the underpad.

11. The mattress protector of claim 1, wherein the underpad comprises an absorbent material selected from gels, foams, cottons or combinations thereof.

12. A mattress protector, comprising:

a waterproof sheet attached to a positioning assembly configured to be removably positionable around a mattress, wherein the waterproof sheet includes at least four separate fabric sections, with at least one fabric section in each quadrant of the waterproof sheet, each fabric section having a top surface to directly engage with at least one underpad having an adhesive applied to at least one location on a bottom surface of the at least one underpad via the adhesive.

13. The mattress protector of claim 12, the positioning assembly further comprising a width adjusting mechanism configured to adjust a width of the positioning assembly according to a size of the mattress.

14. The mattress protector of claim 13, wherein the waterproof sheet has a width generally parallel to the positioning assembly, and wherein the width of the waterproof sheet is less than or equal to eighty-five inches and greater than or equal to fifty inches, and wherein the waterproof sheet is configured to wrap at least partially around a mattress having a width less than the width of the waterproof sheet.

15. The mattress protector of claim 14, the waterproof sheet comprising a centerline extending between a first edge and a second edge of the waterproof sheet, wherein the waterproof sheet includes at least six separate fabric sections positioned adjacent to a perimeter of the waterproof sheet, and wherein two of the at least six separate fabric sections are positioned along the centerline of the waterproof sheet and are larger than the remaining fabric sections.

16. The mattress protector of claim 15, the mattress protector further comprising the at least one underpad with the adhesive applied to the at least one location on the bottom surface of the at least one underpad, wherein a first underpad of the at least one underpad is removably securable via the adhesive to two fabric sections of the at least six separate fabric sections adjacent to the perimeter of the waterproof sheet and to the two larger fabric sections positioned along the centerline of the waterproof sheet.

17. The mattress protector of claim 16, wherein a second underpad of the at least one underpad is removably securable via the adhesive to the same two larger fabric sections positioned along the centerline of the waterproof sheet as the first underpad and to two different fabric sections of the at least six separate fabric sections than the first underpad.

18. A method of using the mattress protector of claim 13, comprising:

placing the mattress protector on a mattress;

positioning the positioning assembly around the mattress;

adjusting the width of the positioning assembly via the width adjusting mechanism to the size of the mattress;

aligning the at least one underpad with the adhesive applied to the at least one location on the bottom surface of the underpad such that the adhesive aligns with the at least one fabric section in each quadrant of the waterproof sheet; and adhering the at least one underpad to the waterproof sheet via the adhesive.

19. The mattress protector of claim 12, wherein the top surface of each fabric section is uncovered and opened from above to directly engage with the at least one underpad.

20. The mattress protector of claim 12, wherein the at least one underpad comprises an absorbent material selected from gels, foams, cottons or combinations thereof.

* * * * *